US008458881B1

(12) United States Patent
Danyo et al.

(10) Patent No.: US 8,458,881 B1
(45) Date of Patent: Jun. 11, 2013

(54) DIE WITH MULTI-SIDED CAVITY FOR SELF-PIERCING RIVETING PROCESS

(75) Inventors: Michael William Danyo, Trenton, MI (US); Aindrea McKelvey Campbell, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/303,065

(22) Filed: Nov. 22, 2011

(51) Int. Cl.
*B21J 15/28* (2006.01)
*B23P 11/00* (2006.01)

(52) U.S. Cl.
USPC ..... 29/432.1; 29/432.2; 29/509; 29/525.06; 29/798; 29/243.522

(58) Field of Classification Search
USPC ..... 29/432.1, 432.2, 505, 509, 525.01, 29/525.05, 525.06, 243.53, 798; 72/466.4, 72/466.5, 469, 470; 411/179, 181, 501
See application file for complete search history.

(56) References Cited

U.S. PATENT DOCUMENTS

| | | | | |
|---|---|---|---|---|
| 5,067,224 | A | 11/1991 | Muller | |
| 5,092,724 | A * | 3/1992 | Muller | 411/179 |
| 5,140,735 | A | 8/1992 | Ladouceur | |
| 6,979,160 | B2 * | 12/2005 | Babej et al. | 29/432.2 |
| 7,596,858 | B2 | 10/2009 | Opper | |
| 8,230,571 | B2 * | 7/2012 | Kovac | 29/525.05 |

FOREIGN PATENT DOCUMENTS

| | | |
|---|---|---|
| JP | 09-141382 | 6/1997 |
| JP | 2002-174219 | 6/2002 |
| JP | 2002-364617 | 12/2002 |
| JP | 2003-290865 | 10/2003 |

OTHER PUBLICATIONS

Nader Elhajj, P.E., Self-piercing riveting for cold-formed steel framing, Strucural Engineering and Design.

* cited by examiner

*Primary Examiner* — David B Jones
(74) *Attorney, Agent, or Firm* — L.C. Begin & Associates, PLLC

(57) ABSTRACT

A die member is provided for a self-piercing riveting process, the die member comprising a die cavity having an axis and a plurality of sides positioned about the axis, wherein each side extends along a plane which includes a chord connecting two points along a circle centered on the axis.

20 Claims, 4 Drawing Sheets

DIE WITH MULTI-SIDED CAVITY FOR SELF-PIERCING RIVETING PROCESS

BACKGROUND OF THE INVENTION

The embodiments of the present invention relate to a self-piercing riveting process and, more particularly, to a die member for use in a self-piercing riveting process.

In the joining of components used in high volume vehicle production, it may be desirable to use mechanical fasteners to help achieve the required strength and durability of joints. One type of mechanical fastener used in vehicle production is a self-piercing rivet (SPR).

The general principles of self-piercing rivet technology are known in the art. To apply a self-piercing rivet to workpieces to be joined, a portion of a first workpiece or panel is placed upon a bearing surface of a die member, so as to overlie a die cavity formed in the die member. Portions of one or more additional panels are then stacked on the portion of the first panel overlying the die cavity. The panels are secured in position with respect to each other and with respect to the die member, to prevent relative movement of the parts during application of the rivet. The die cavity may also contain a die post which assists in forcing a portion of the rivet to spread or deflect radially outwardly when pressure sufficient to pierce the first workpiece is applied to the rivet. The rivet also pierces surfaces of the second panel overlying the first panel. In a known manner, up to four layers of material may be joined using existing SPR processes.

During application of the rivet to the workpieces to be joined, a feature known as an SPR "button" is produced. This SPR button is in the form of a protrusion in a surface of the second panel along a side of the second panel opposite the side pierced by the rivet. One of the challenges encountered during SPR joining is the nucleation and propagation of cracks on the "button" side of the joint, along corners of the button shaped by the floor and walls of the die cavity during the SPR operation. The presence and size of these cracks can affect the quality of the joint and the viability of SPR technology as a fastening option.

Thus, a need exists for a die geometry in which crack formation in the rivet material along the SPR button during formation of the button is reduced or minimized.

SUMMARY OF THE INVENTION

In one aspect the embodiments of the present invention, a die member for a self-piercing riveting process includes a die cavity having an axis and a plurality of sides positioned about the axis. Each side of the die cavity extends along a plane which includes a chord connecting two points along a circle centered on the axis.

In another aspect the embodiments of the present invention, a die member for a self-piercing riveting process includes a die cavity formed in the die member. A perimeter of the cavity is formed by a plurality of sides and a plurality of fillet radii. Each end of each side of the die cavity is connected by a fillet radius to an adjacent side of the cavity at an end of the adjacent side.

In another aspect the embodiments of the present invention, a die member for a self-piercing riveting process includes a bearing surface and a die cavity forined in the bearing surface. The die cavity includes a cavity floor and a central axis extending through the cavity floor. A plurality of cavity sides extends between the cavity floor and the bearing surface. At least one of the sides is sloped away from the axis in a direction proceeding from the floor toward the bearing surface.

In another aspect the embodiments of the present invention, a die member for a self-piercing riveting process includes six wall portions, each end of each wall portion being connected to an adjacent wall portion at an end of the adjacent wall portion.

BRIEF DESCRIPTION OF THE DRAWINGS

In the drawings illustrating embodiments of the present invention.

DETAILED DESCRIPTION

Figure 1:
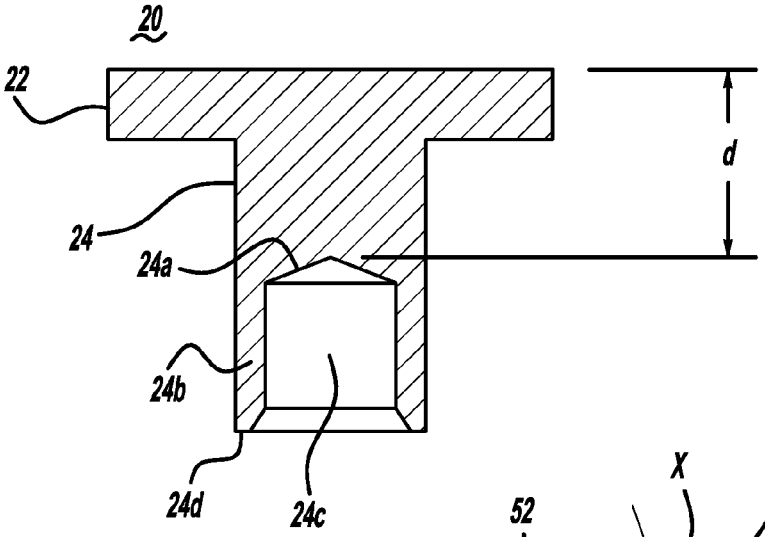
FIG. 1 is a cross-sectional view of a self-piercing rivet usable with a die member in accordance with an embodiment of the present invention for joining portions of a pair of stacked panels.

The exemplary embodiments described herein provide detail for illustrative purposes and are subject to many variations in structure and design. It is to be understood that the phraseology and terminology used herein are for the purpose of description and should not be regarded as limiting.

The terms "a" and "an" herein do not denote a limitation as to quantity, but rather denote the presence of at least one of the referenced items. Also, use herein of the terms "including," "comprising," "having" and variations thereof is meant to encompass the items listed thereafter and equivalents thereof as well as allowing for the presence of additional items. Further, the use of terms "first", "second", and "third", and the like herein do not denote any order, quantity, or relative importance of the items to which they refer, but rather are used to distinguish one element from another.

Unless limited otherwise, terms such as "configured," "disposed," "placed", "coupled to" and variations thereof herein are used broadly and encompass direct and indirect attachments, couplings, and engagements. In addition, the terms "attached" and "coupled" and variations thereof are not restricted to physical or mechanical attachments or couplings.

Unless noted otherwise, similar reference numerals appearing in views of different embodiments of the present invention refer to similar elements. For example, reference numeral 59 in FIG. 3 refers to a side or wall portion of the die cavity 52 shown in FIG. 3, while reference numeral 59' in FIG. 5 refers to a side or wall portion of the die cavity 52' shown in FIG. 5.

FIGS. 1-9 show one embodiment of an exemplary self-piercing rivet 20 and a die member 50 usable in a self-piercing riveting operation for securing a pair of stacked panels together. The self-piercing rivet and die structure described herein may be utilized in any application where rivets are presently used, such as securing together panels and closures. As used herein, "panel" refers to any plate, panel or metal sheet having a thickness suitable for permitting piercing of the panel or a surface of the panel with the rivet as described herein.

A self-piercing rivet and associated die member of the embodiments of the present invention may be adapted for mass production applications, including automotive applications. Embodiments of the self-piercing rivet and die member disclosed herein are suitable for installation and use in a conventional die press, such as utilized by the automotive industry to join sheet metal parts, including body panels and structural components. In such applications, the press applies one or more self-piercing rivets with each stroke of the press.

FIG. 1 shows an example of a self-piercing rivet 20 of known construction. In the embodiment shown in. FIG. 1, rivet 20 includes a head portion 22 and a body portion 24 extending from the head portion. Body portion 24 is at least partially hollow and includes a base surface 24*a* spaced apart a distance d from the head portion 22, and an annular wall 24*b* surrounding the base surface 24*a*. Base surface 24*a* and wall 24*b* combine to define a cavity 24*c*. In the embodiment shown in. FIG. 1, base surface 24*a* is concave.

An end 24*d* of wall 24*b* is formed into a cutting or piercing surface configured to pierce a panel or workpiece in a manner known in the art, when the wall end 24*d* is forced into contact with the workpiece by application of a pressing force on the rivet 20. If desired, an inner portion of wall 24*b* adjacent the wall end 24*d* may be chamfered as shown in FIG. 1. Similarly, if desired, an outer portion of wall 24*b* adjacent the wall end 24*d* may also be chamfered. As is known in the art, self-piercing rivet 20 may be formed from steel or any other suitable material, and may be heat-treated for surface hardness, ductility, etc.

Figure 2:
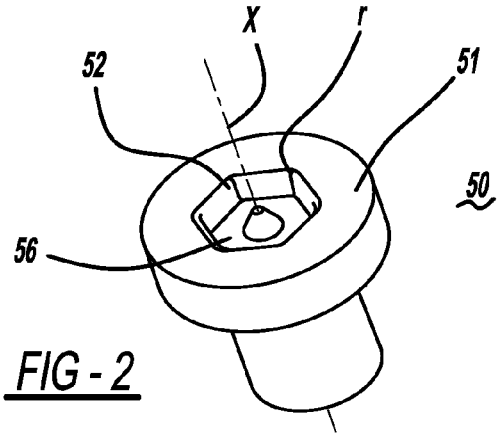
FIG. 2 is a perspective view of a portion of a multi-sided die member in accordance with one embodiment of the present invention.
Figure 3:
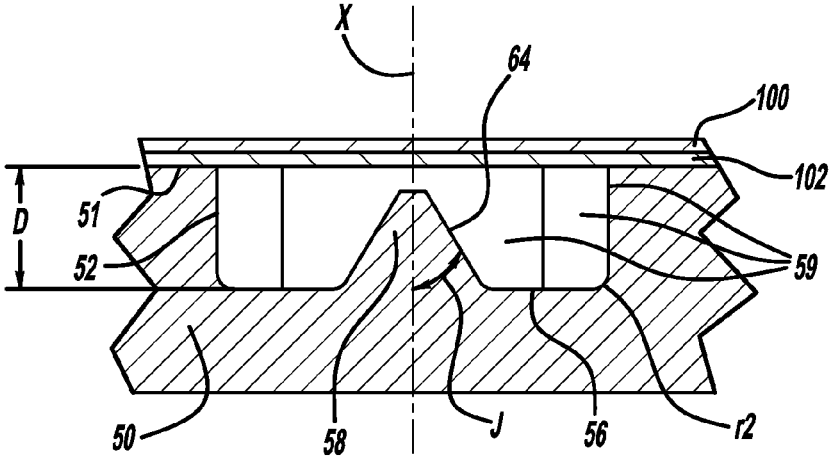
FIG. 3 is a cross-sectional view of the portion of the multi-sided die member shown in FIG. 2.
Figure 4:
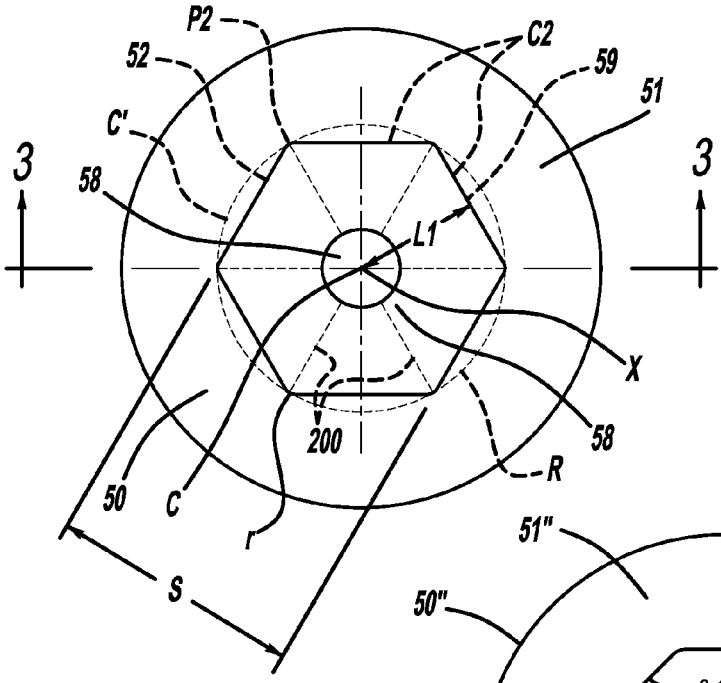
FIG. 4 is a plan view of the portion of a die member shown in FIG. 2, showing positions of die cavity sides or wall portions along a perimeter of the die cavity.

FIGS. 2-4 show various views of a die member 50 in accordance with one embodiment of the present invention. The die member 50 includes bearing surface 51 and a die cavity 52 formed in the bearing surface. Bearing surface 51 supports portions of workpieces 100 and 102 (FIG. 3) being joined by the riveting operation. Cavity 52 includes an annular floor or die surface 56 surrounding a center die post 58. A central axis X of the die cavity 52 extends through center post 58 and floor 56. If desired, the die member may include a relief port (not shown) which permits outflow of air which would otherwise be entrapped between the second panel 102 and die cavity floor 56 during a riveting operation, as described below. An outer surface 64 of the die post tapers radially outwardly as it extends into the cavity toward floor 56. Also, in the embodiment shown in FIGS. 2-3, surface 64 blends smoothly into the die cavity floor 56.

In one particular embodiment, die post outer surface 64 forms an angle J in the range of 9.5 degrees to 30.5 degrees inclusive with respect to axis X. In another particular embodiment, the die post is omitted from the die cavity. In this embodiment, deformation of the rivet wall 24*b* is produced by pressure of the wall against die surface 56.

In particular embodiments, a multi-sided or polygonal die cavity 52 in accordance with the present invention has a plurality of wall portions or sides 59 extending between die surface 56 and bearing surface 51. Wall portions 59 are straight within the limits of manufacturing tolerances.

In a particular embodiment, the depth of the die cavity as measured from a plane defined by bearing surface 51 to a plane defined by die surface 56 and along a plane extending parallel to axis X is within the range of 1.95 mm to 3.30 mm inclusive.

Referring to FIG. 4, in a particular embodiment, a span S of the die cavity between opposite straight sides when measured at the bearing surface 51 is within the range of 6.95 mm to 12.05 mm inclusive.

Referring to FIG. 4, in particular embodiments, the arrangement of sides 59 along the die cavity perimeter for a given number of sides may be defined by forming on the die member a circle C' having a center C and a radius R, and extending a plurality of angularly evenly spaced lines 200 outwardly from center C to intersect the circle at intersection points P2. The number of lines 200 extending from center C will be equal to the number of sides 59 desired for the perimeter of cavity 52. Each side 59 then extends along a plane which includes a chord C2 of circle C' connecting adjacent points of intersection P2. As used herein, the term "chord" is defined as a single straight line segment joining two points on a curve. In FIG. 4, the curve is circle C'. The particular embodiment in FIG. 4 illustrates the layout of a six-sided or hexagonal die cavity having sides of equal length.

Figure 5:
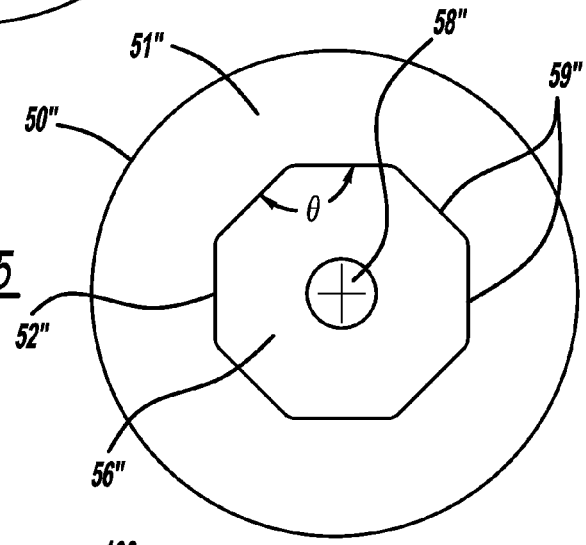
FIG. 5 is a plan view of a portion of a multi-sided die member in accordance with another embodiment of the present invention.

In these embodiments, central axis X of the die cavity extends through circle center C. Thus, axis X is spaced an equal distance R from each point P2 at which adjacent chords C2 intersect, as shown in FIG. 4. In addition, as shown in FIG. 5, equal angles θ facing into the die cavity are formed between adjacent chords C2.

In the view shown in FIG. 4, and also in the embodiment shown in FIG. 3, the plane along which the side 59 extends is parallel to axis X and extends between a plane defined by bearing surface 51 and a plane defined by floor 56. Also, in this embodiment, it may be seen that a line L1 connecting the central axis X with a point on the side 59 closest to the axis is perpendicular to the side 59 at the point.

In a particular embodiment, the plane along which the side 59 extends perpendicular to a plane defined by the bearing surface 51 and is also perpendicular to a plane defined by cavity floor 56.

Figure 10:
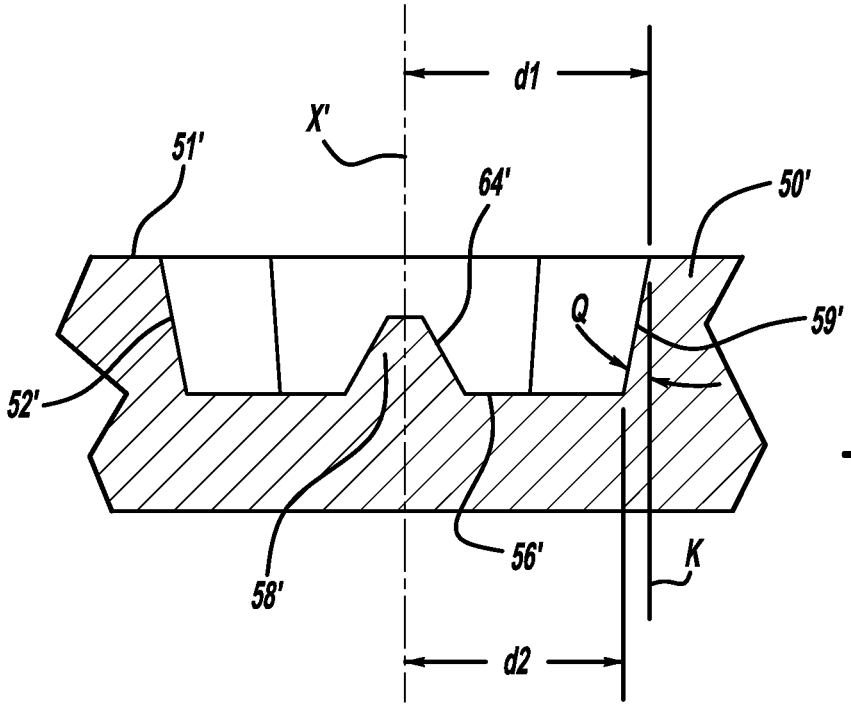
FIG. 10 is a plan view of a portion of a multi-sided die member in accordance with another embodiment of the present invention.

Referring to FIG. 10, in another embodiment, a plane along which at least one of sides 59 extends is angled inwardly toward axis X in a direction proceeding from bearing surface 51 toward floor 56. This sloping of wall 59 facilitates extraction of the SPR button from the die member 50. Sloping of the cavity wall(s) or sides 59 from bearing surface 51 toward floor 56 may also be used to reduce the radial distances from the axis X to the portions of the wall(s) residing along or proximate the floor of the die cavity (relative to the distances from axis X to portions of bearing surface 51), thereby shortening the radial deformation or "spread" of the SPR button within the cavity during button formation. It is believed that this aids in avoiding or reducing the occurrence of microcracks.

The procedure set forth above may be used to provide a die cavity having any desired number of cavity sides of equal length (taking into account manufacturing tolerances relating to the lengths of the sides).

In addition, a fillet radius r is formed at each intersection of adjacent wall portions 59 and extends along each of the wall portion intersections between die surface 56 and bearing surface 51. In one embodiment, each radius r has a value within the range 0.25 mm-1.0 mm inclusive. In one particular embodiment, the radii r have a value in the range of 0.75 mm to 3.25 mm inclusive.

In one embodiment, sides 59 have equal lengths with equal angles θ (again, within the limits of manufacturing tolerances) formed between each two adjacent sides and facing into the die cavity.

In one embodiment, as shown in FIGS. 2-4, a perimeter of cavity 52 is in the shape of a six-sided polygon, or hexagon. In the particular embodiment of a hexagon shown in FIGS. 2-4, sides 59 have equal lengths with equal angles of 120° formed between each two adjacent sides.

FIG. 5 shows a die member 50" in accordance with another embodiment of the present invention. In this embodiment, a perimeter of die cavity 52" is in the shape of an eight-sided polygon, or octagon. In the particular embodiment of an octagon shown in FIG. 5, sides 59" have equal lengths with equal angles of θ=135° formed between each two adjacent sides. In this embodiment, bearing surface 51", die post 58", and cavity floor 56" are structured as previously described.

Figure 11:
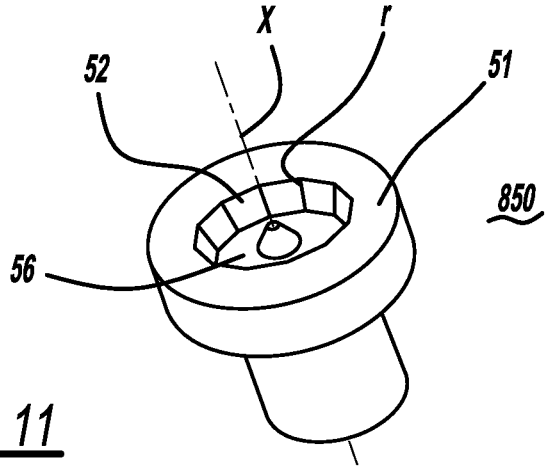
FIG. 11 is a perspective view of a portion of a multi-sided die member in accordance with another embodiment of the present invention.

Referring to FIG. 11, in another particular embodiment 850, the die cavity has twelve straight sides.

In alternative embodiments, rather than six or eight straight sides, the die cavity 52 may have a greater number of straight sides or a lesser number of straight sides, according to the requirements of a particular process. Thus, while the above examples described hexagonal and octagonal die cavities, a cavity in accordance with an embodiment of present invention may have any desired number of sides of substantially equal length, depending on the properties and thicknesses of the materials to be joined, the number of sheets to be joined, and other pertinent factors. In particular embodiments, cavities having anywhere from three to twenty sides, inclusive, are contemplated.

In addition, a radius r2 is formed at the intersection between die surface 56 and each of wall portions 59. In one embodiment, each radius is has a value within the range 0.25 mm-1.0 mm inclusive. In one particular embodiment, the radii r2 have values in the range of 0.75 mm to 3.25 mm inclusive.

Referring to FIG. 10, in another particular embodiment, the die member 50' includes bearing surface 51' and die cavity 52' formed in the bearing surface. Die cavity 52' includes cavity floor 56' and central axis X' extending through the cavity floor. A plurality of cavity wall portions or sides 59' extends between the cavity floor 56' and the bearing surface 51'. A portion of at least one of the sides 59' adjacent the bearing surface 51' is spaced a first distance d1 apart from the axis X. A portion of the at least one of the sides 59' adjacent the floor 56' is spaced a second distance d2 apart from the axis X. In this embodiment, the first distance d1 is greater than the second distance d2. Thus, in this embodiment, one or more of sides 59' is sloped relatively outwardly (i.e., away from axis X) in a direction proceeding from floor 56' toward bearing surface 51'. This sloping of wall 59' facilitates extraction of the SPR button from the die member 50'.

In a particular embodiment, all of the sides 59' of the cavity are sloped outwardly as described above.

In the embodiment shown in FIG. 10, one or more of sides 59' is sloped such that the a plane defined by the side forms an angle Q with a plane K extending parallel to axis X' and along a line defined by an intersection of the side plane and bearing surface 51'. In a particular embodiment, angle Q has a value within the range of 0 degrees to 15.5 degrees inclusive.

Any of the embodiments of the die member described herein may be formed from steel or any other suitable material or materials.

FIGS. 6-9 are perspective views illustrating an assembly sequence for joining portions of a pair of stacked panels 100 and 102 using a self-piercing rivet and complementary die member, in accordance with one embodiment of the present invention. Where the self-piercing rivets 20 are applied by a die press, the rivets may be fed to an installation head (not shown) which is attached to one platen of the die press.

The installation head may include a punch 42 which having a bore or cavity (not shown) which receives the head portion 22 of the rivet. The punch includes a driving surface 46 which is driven against the rivet head portion. Die member 50 may be attached to the opposite die platen (not shown) with the die cavity 52 in coaxial alignment with the punch 42.

Figure 6:
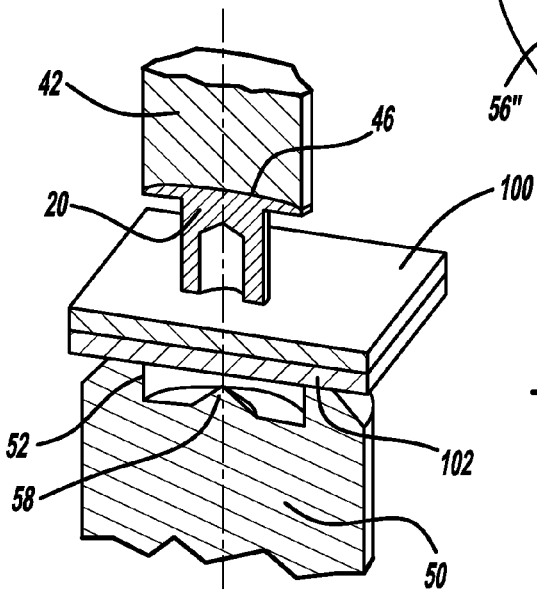
FIGS. 6-9 show a sequence of operations in applying a self-piercing rivet to a pair of panels to join the panels.

FIG. 6 shows the rivet 20 prior to contact with a first panel or workpiece 100. Referring to FIGS. 1-4 and 6-9, in operation, the rivet body portion 24 is driven into the first panel 100 in coaxial alignment with the central die post 58 of the die cavity 52. In actual operation, the panels 100 and 102 may be securely clamped to prevent movement of the panels relative to each other and to prevent movement of panel 102 relative to bearing surface 51.

Figure 7:
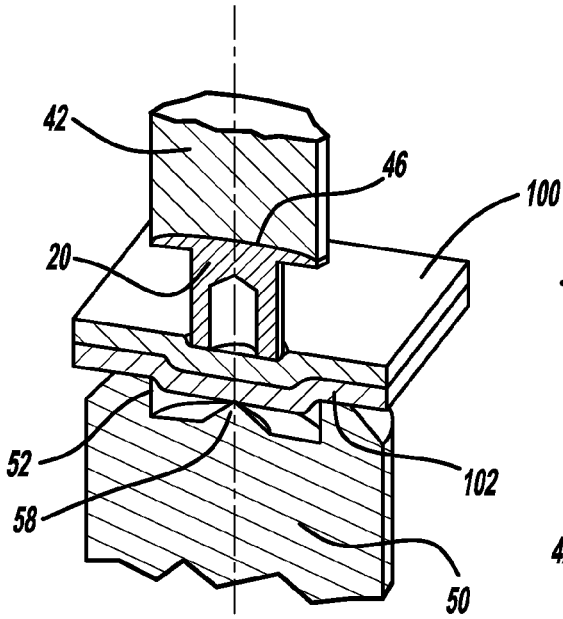

FIG. 7 shows the rivet being driven into first panel 100. As the body portion 24 is driven into the panel, the piercing surface along annular wall **24*b* deforms and then pierces the surface of first panel 100. Wall 24*b* also forces the unsupported portion of second panel 102 into die cavity 52 and into engagement with die post 58**.

Figure 8:
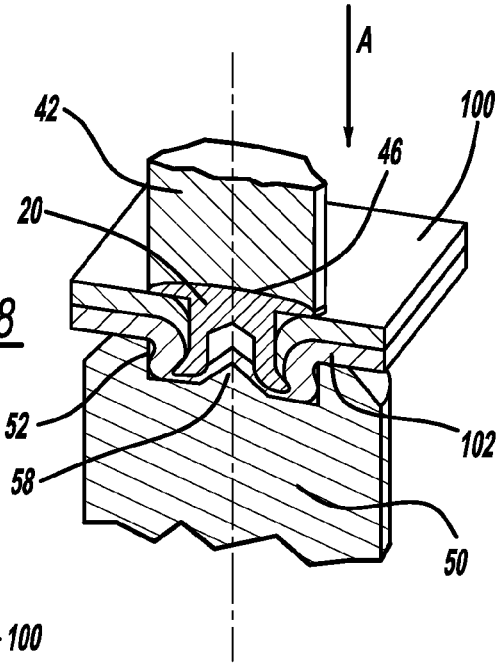

Referring to FIG. 8, when the unsupported second panel portion contacts die post 58, further deflection of the second panel portion is prevented, and the portion of the second panel residing within the die cavity is now supported. Thus, further motion of the rivet in the direction of arrow "A" causes the rivet wall **24*b* to deflect radially outwardly as the wall 24*b* engages the supported portion of second panel 102. As seen in FIG. 8, continued downward deflection and radial spreading of the rivet wall 24*b* produces a corresponding downward and radially outward deflection of the portion of the second panel not supported by the die post 58, along the floor of the die cavity 52. This action produces a "die button" or SPR button 150**, which is defined as a protrusion in a surface of the second panel along a side of the second panel opposite the side along which the rivet is applied.

Figure 9:
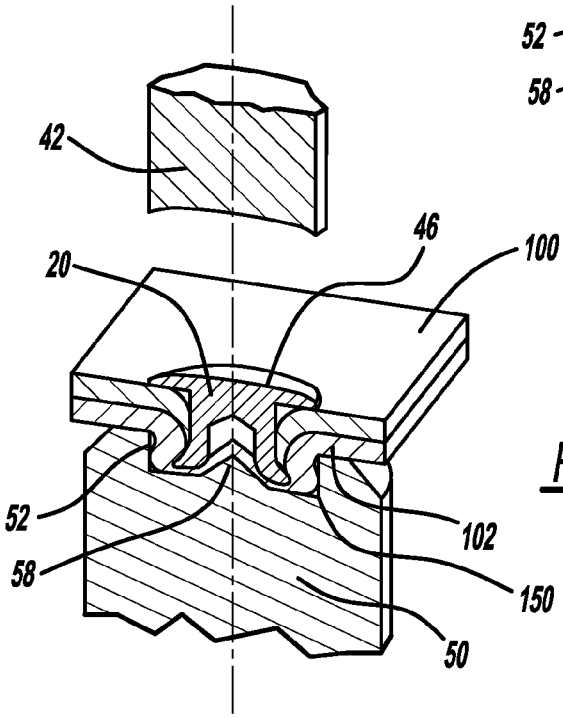

The rivet design, die member design, and process parameters are specified so that rivet wall portion **24*b* does not pierce completely through the thickness of second panel 102 during formation of the die button. The portion of the second panel deflected into die cavity 52 expands radially until it abuts cavity wall portions 59. FIG. 9 shows the finished riveted joint after withdrawal of the punch 42**.

It is believed that crack nucleation in the rivet is related to the lack of ductility which often exists in high strength alloys (including aluminum based materials) from which the rivet may be formed. It is believed that the cracks observed in SPR buttons nucleate and grow after a critical stress or cumulative strain is achieved in a given material. During self-piercing rivet processes, material is displaced and is subjected to significant multi-axial stresses and strains during SPR button formation within the die cavity. Often, if cracks are initiated in the SPR button, the cracks are observed along the button edge and surface. It is believed that the largest cumulative strains in the rivet material occur along surfaces of the button located the greatest distance from the central axis of the die cavity, due to significant material displacements required and due to the need for the die cavity to accommodate the volume of the deformed rivet.

It has been found that the geometry of the die cavity can play a significant role in controlling displacement of the rivet material during formation of the SPR button. It is believed that an SPR button formed in a multi-sided die cavity 52 defined as described above using a circle C' with a radius R will experience less crack formation than an SPR button formed in a circular die cavity having the radius C'. The material of second panel 102 is prevented from deforming uniformly radially outwardly by the straight wall portions 59. Thus, rather than deforming to a circular configuration having the uniform radius R of circle C', the outer boundary of the SPR button acquires the shape of the multi-sided die cavity 52. Thus, it is believed that use of straight wall portions 59 in restricting or confining deformation of the SPR button material aids in mitigating crack formation and crack propagation along the outer surfaces of the SPR button 150.

It is also seen that, as the number of straight wall portions forming the sides of die cavity 52 increases, the area of the floor 56 of cavity 52 increases, more closely approaching the floor area that would be provided with a circular cavity having the radius R. This increase in floor area allows a relatively greater radial expansion of the material forming the die button. Thus, in a self-piercing rivet application in which the area or space that may be occupied by the riveted joint is restricted, the die cavity floor area available for expansion of the die button can be maximized within a permissible circular joint area or die button area $\pi ER^2$ of circle C' while eliminating or mitigating crack formation that would otherwise occur during uniform radial expansion of the die button material.

The number of die cavity sides may also be specified so as to take into account the cavity volume needed to accommodate a given rivet size while still minimizing cumulative strain during defoimation of a rivet material having a given ductility. This design flexibility with regard to die cavity dimensions also aids in eliminating or mitigating crack formation.

The optimum configuration of wall portions 59 can be determined iteratively and/or analytically to meet the requirements of a particular application, based on factors such as rivet design, panel materials and thicknesses, permissible SPR button area, and other pertinent factors.

It will be understood that the foregoing description of the present invention is for illustrative purposes only, and that the various structural and operational features herein disclosed are susceptible to a number of modifications, none of which departs from the spirit and scope of the present invention. The preceding description, therefore, is not meant to limit the scope of the invention. Rather, the scope of the invention is to be determined only by the appended claims and their equivalents.

What is claimed is:

1. A die member for a self-piercing riveting process, the member comprising a die cavity having an axis and a number N of flat sides positioned about the axis, wherein each side lies along a plane including a chord connecting two points along a circle centered on the axis, and wherein an included angle between radii extending from the axis to opposite ends of any chord is equal to 360/N degrees.

2. The die member of claim 1 wherein each plane along which an associated side extends is parallel to the axis.

3. The die member of claim 1 wherein the die member further comprises a bearing surface, wherein the die cavity has a floor, and wherein each plane along which an associated side extends is perpendicular to a plane defined by the bearing surface and is also perpendicular to a plane defined by cavity floor.

4. The die member of claim 1 wherein the die member further comprises a bearing surface, wherein the die cavity has a floor, and wherein a plane along which at least one side of the plurality of sides extends is angled toward the axis in a direction proceeding from the bearing surface toward the floor.

5. The die member of claim 1 wherein the number of cavity sides is within the range of 3-20 inclusive.

6. The die member of claim 5 wherein each side has a length, and wherein the lengths of all of the sides are equal.

7. The die member of claim 1 wherein the number of cavity sides is equal to twelve.

8. A die member for a self-piercing riveting process, the die member comprising a die cavity formed in the die member, a perimeter of the cavity being formed by a plurality of sides and a plurality of fillet radii, each end of each side being connected by a fillet radius to an adjacent side at an end of the adjacent side, wherein each radius r has a value within the range 0.25 mm-3.25 mm inclusive.

9. The die member of claim 8 wherein the number of cavity sides is within the range of 3-20 inclusive.

10. The die member of claim 8 wherein each of the sides is straight.

11. The die member of claim 8 wherein all of the wall portions are flat wall portions.

12. The die member of claim 8 wherein the number of sides is equal to six.

13. A die member for a self-piercing riveting process, the die member comprising:

a bearing surface;

a die cavity formed in the bearing surface, the die cavity including a floor and a central axis extending through the floor;

a plurality of flat sides extending between the floor and the bearing surface, wherein at least one of the sides is sloped away from the axis in a direction proceeding from the floor toward the bearing surface.

14. The die member of claim 13 wherein the number of cavity sides is within the range of 3-20 inclusive.

15. The die member of claim 13 wherein the number of straight cavity sides is equal to twelve.

16. The die member of claim 13 wherein each of the sides is straight.

17. A die member comprising a die cavity having an axis and a plurality of flat sides disposed about the axis, each side intersecting a chord connecting two points along a circle centered on the axis, the cavity being structured to receive therein a portion of a die button responsive to driving of a self-piercing rivet into a first panel of a plurality of panels stacked over the die cavity.

18. The die member of claim 17 wherein the number of cavity sides is within the range of 3-20 inclusive.

19. The die member of claim 17 wherein a distance from a plane defined by the bearing surface to a plane defined by the cavity floor and measured along a plane extending parallel to the central axis is within the range of 1.95 mm to 3.30 mm inclusive.

20. The die member of claim 17 wherein the die cavity has six flat sides disposed about the axis.

* * * * *